US005613671A

United States Patent [19]

Fricke et al.

[11] Patent Number: 5,613,671

[45] Date of Patent: Mar. 25, 1997

[54] DEVICE FOR CORRECTING SKEWED SHEETS IN A FEEDER OF A SHEET-FED PRINTING PRESS

[75] Inventors: Andreas Fricke, Eberbach; Jochen Renner, Heidelberg; Norbert Thünker, Hirschberg, all of Germany

[73] Assignee: Heidelberger Druckmaschinen AG, Heidelberg, Germany

[21] Appl. No.: 410,845

[22] Filed: Mar. 27, 1995

[30] Foreign Application Priority Data

Mar. 26, 1994 [DE] Germany ..... 44 10 529.0

[51] Int. Cl.[6] ..... B65H 3/40

[52] U.S. Cl. ..... 271/91; 271/107; 271/253

[58] Field of Search ..... 271/11–13, 91, 271/93, 95, 96, 107, 226, 242, 253–255

[56] References Cited

U.S. PATENT DOCUMENTS

| | | | |
|---|---|---|---|
| 3,809,389 | 5/1974 | Wirz | 271/93 X |
| 4,438,916 | 3/1984 | Kawaguchi | 271/93 |
| 4,940,221 | 7/1990 | Wirz et al. | 271/107 |
| 5,029,836 | 7/1991 | Swaneck | 271/107 |
| 5,033,732 | 7/1991 | Pollich . | |

FOREIGN PATENT DOCUMENTS

| | | | |
|---|---|---|---|
| 1177652 | 10/1966 | Germany . | |
| 1247342 | 8/1967 | Germany | 271/107 |
| 3843152 | 6/1990 | Germany . | |
| 1012035 | 12/1965 | United Kingdom | 271/11 |

*Primary Examiner*—Boris Milef

*Attorney, Agent, or Firm*—Herbert L. Lerner; Laurence A. Greenberg

[57] ABSTRACT

Device for skewed sheet correction in a feeder of a sheet-fed printing press having at least one sucker which is adjustable in height and is disposed on a driven movable sucker carrier for horizontally transporting and simultaneously aligning a sheet lifted from a sheet pile, a rocker arm mounted in a frame of the printing press, the sucker carrier being articulatingly connected to the rocker arm so as to be movable in a feeding direction of the sheet and swingably driven, and a cam guide which is adjustable in height, the sucker carrier being braced against the cam guide, includes another rocker arm adjustably supported in the press frame, the sucker carrier being spaced apart from the first-mentioned rocker arm in a direction transverse to the sheet feeding direction and being articulatingly connected to the other rocker arm.

7 Claims, 4 Drawing Sheets

Y
Z
X 1
1
A3
A0
14
13
2
E
1
A2
F
C0
A1
3
4
B
18
B0∞
5
3
17
6

DEVICE FOR CORRECTING SKEWED SHEETS IN A FEEDER OF A SHEET-FED PRINTING PRESS

BACKGROUND OF THE INVENTION

Field of the Invention

The invention relates to a device for correcting skewed sheets in a feeder of a sheet-fed printing press, the device, more particularly, having at least one sucker which is adjustable in height and is disposed on a driven movable sucker carrier for horizontally transporting and simultaneously aligning a sheet lifted from a sheet pile, the sucker carrier being articulatingly connected to a rocker arm which is mounted in a frame of the printing press so as to be movable in a feeding direction of the sheet and swingably driven, the sucker carrier being braced against a cam guide which is adjustable in height.

Such a device is intended to provide an accurate alignment of the sheet while it is yet on its transport path from the sheet pile toward the front or side lay marks or some other transport means for further conveyance or feeding of the sheet, in order thereby to enhance the reliability of the sheet alignment, especially at high printing speeds and/or with sensitive or delicate printing materials or stock. Various devices have therefore been provided by which the sheet, on its transport path toward the front lay marks or toward the transport means which further convey or feed the sheet, is rotated slightly about its vertical axis depending upon how skewed it is, and is thus aligned with its leading edge precisely perpendicularly to the direction of conveyance or feeding.

The device described in generic terms in the introduction hereto is the device heretofore known from its use with the conventional so-called "RYOBI 520" sheet-fed printing press. In this heretofore known construction, the correction of a skewed sheet is effected by changing the location of the rocker arm by means of an adjusting screw with an adjusting wheel, the latter moving constantly with the rocker arm. For kinematic reasons, this change in the length of the rocker arm also changes the height of the sucker. Intrinsically, the height of the sucker is adjusted by an adjustment of the scanner switch of the device for tracking the stack of sheets to be worked through. It has been found to be disadvantageous, if an intentional increase in spacing between the sucker and the surface of the sheet pile is effected so as to avoid the feeding of double sheets, that the sheet-pile table must be lowered a desired amount after the adjustment has been made. Only in this way can the spacing sought-after become effective.

In a different type of sheet-fed printing press, a sucker transmission is used having two cam disks which, on the one hand, in cooperation with the cam segment, control the sucker stroke and, on the other hand, control the horizontal transport movement. Due to a coordination of these two am roller movements, a desired guidance of the sucker is provided. An adjustment of a kinematic dimension would necessarily affect both partial movements, a result which is undesired German Patent 11 77 652 describes a device for correcting skewed sheets, wherein two suction nozzles are swivellable in common, by the action of a control cam, about a shaft which is swingably moved by a second control cam. In order to effect an acceleration or deceleration of a suction nozzle, this suction nozzle is rotatably mounted and is disposed so as to swivellable about a stationary pivot axis under the influence of an adjustable connecting rod during the transport movement. This swivelling motion of the one nozzle is achieved by means of a lever which is connected to a tie rod having an end thereof rotatable about a pin or trunnion, and this pin or trunnion can be adjusted by an adjusting device towards both sides by the shaft of a connecting rod carrying the nozzles.

SUMMARY OF THE INVENTION

It is an object of the invention to provide a device for correcting skewed sheets in a feeder of a sheet-fed printing press wherein sucker height adjustment and skewed sheet correction are effected by requisite control elements which are disposed in a stationary manner in the frame of a suction head, and both adjustments become operative for the most part independently of one another, thereby providing a marked improvement over the heretofore known devices of this general type.

With the foregoing and other objects in view, there is provided, in accordance with the invention, a device for skewed sheet correction in a feeder of a sheet-fed printing press having at least one sucker which is adjustable in height and is disposed on a driven movable sucker carrier for horizontally transporting and simultaneously aligning a sheet lifted from a sheet pile, a rocker arm mounted in a frame of the printing press, the sucker carrier being articulatingly connected to the rocker arm so as to be movable in a feeding direction of the sheet and swingably driven, and a cam guide which is adjustable in height, the sucker carrier being braced against the cam guide, comprising another rocker arm adjustably supported in the press frame, the sucker carrier being spaced apart from the first-mentioned rocker arm in a direction transverse to the sheet feeding direction and being articulatingly connected to the other rocker arm.

In accordance with another feature of the invention, the device includes a bearing for the first-mentioned rocker arm fixed to the press frame, the other rocker arm having a support bearing disposed coaxially with the bearing for the first-mentioned rocker arm, in a zero position of the sucker, and being adjustable out of this zero position.

In accordance with a further feature of the invention, the device includes an adjusting lever having an articulating axis on the press frame disposed coaxially with the articulating axis of the first-mentioned rocker arm on the sucker carrier, in a zero position of the sucker, the other rocker arm being supported on the adjusting lever, and an adjusting device connecting the adjusting lever adjustably about an articulating axis to the press frame.

In accordance with an added feature of the invention, the device includes a rocker-arm lever rigidly connected to the other rocker arm, the other rocker arm being articulatingly connected through the intermediary of a coupling member to the rocking-arm lever.

In accordance with an additional feature of the invention, more than the one sucker are disposed on the sucker carrier.

In accordance with yet another feature of the invention, the device includes a second sucker carrier to which the other rocker arm is connected so as to articulate about an axis extending transversely to the sheet feeding direction, the second sucker carrier being supported so as to articulate about a swivel axis on the first-mentioned sucker carrier.

In accordance with a concomitant feature of the invention, the device includes a sucker-bearing second sucker carrier to which the other rocker arm is connected so as to articulate about an axis extending transversely to the sheet feeding direction, the second sucker carrier being supported so as to articulate about the articulating axis of the first-mentioned sucker carrier, the other rocker arm having a joint bearing connecting the other rocker arm to the press frame, the joint bearing having the articulating axis extending therethrough, about which the adjusting lever of the adjusting device is adjustably connected to the press frame, the articulating axis of the joint bearing and the swivel axis of the second sucker carrier being aligned coaxially with one another in a zero position of the suckers.

By means of the foregoing structural features, the sucker height adjustment and the adjustment for effecting the skewed sheet correction can be performed practically without having any effect upon one another and can take place while the machine is in operation. Both the adjusting elements for adjusting the sucker height and the adjusting elements for correcting the skewed sheets are disposed on stationary parts of the printing press.

Other features which are considered as characteristic for the invention are set forth in the appended claims.

Although the invention is illustrated and described herein as embodied in a device for correcting skewed sheets in a feeder of a sheet-fed printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
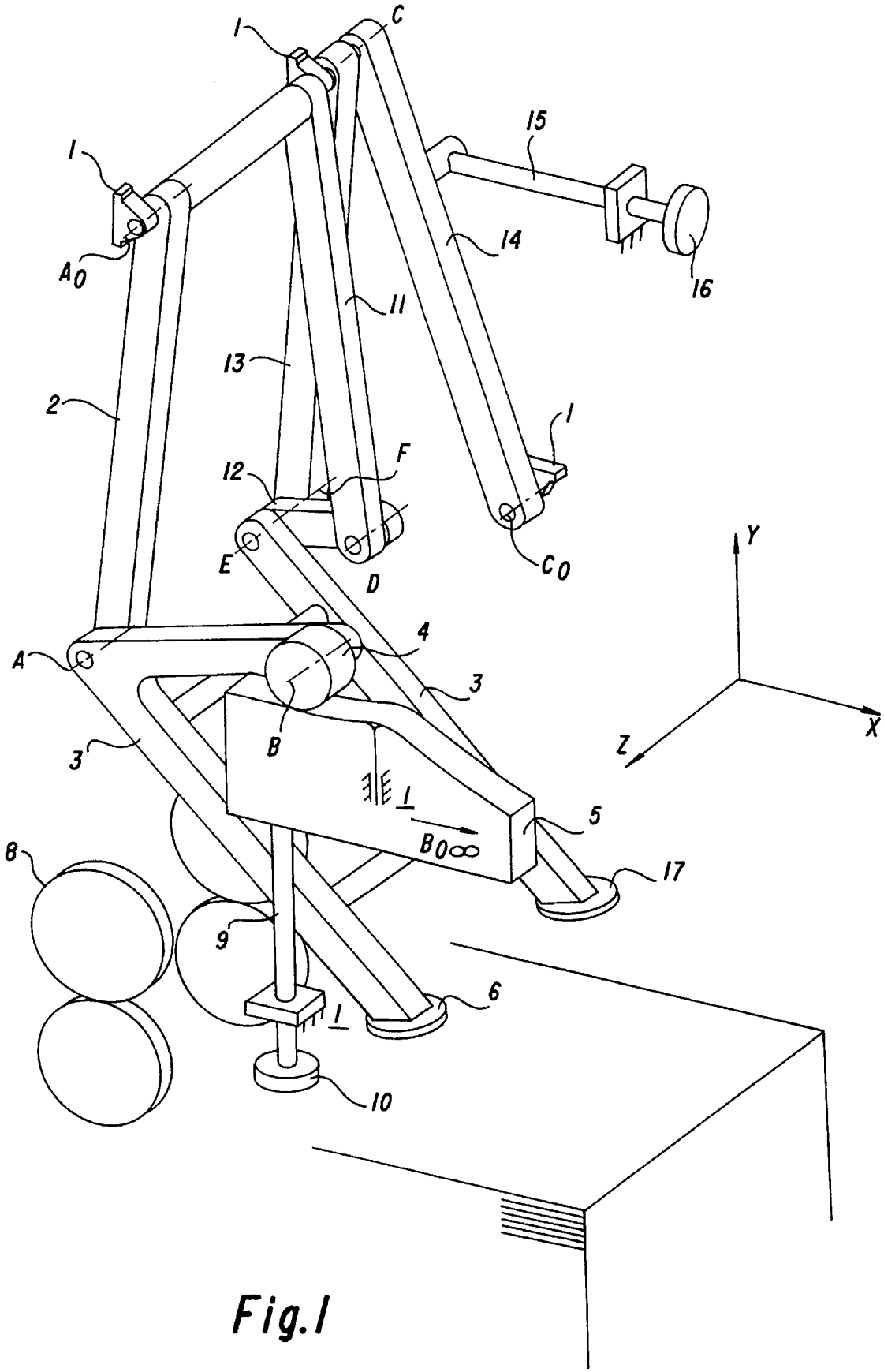
FIG. 1 is a perspective view, partly diagrammatic and schematic, of the device for correcting skewed sheets according to the invention including a lever transmission for a sucker drive.
Figure 2:
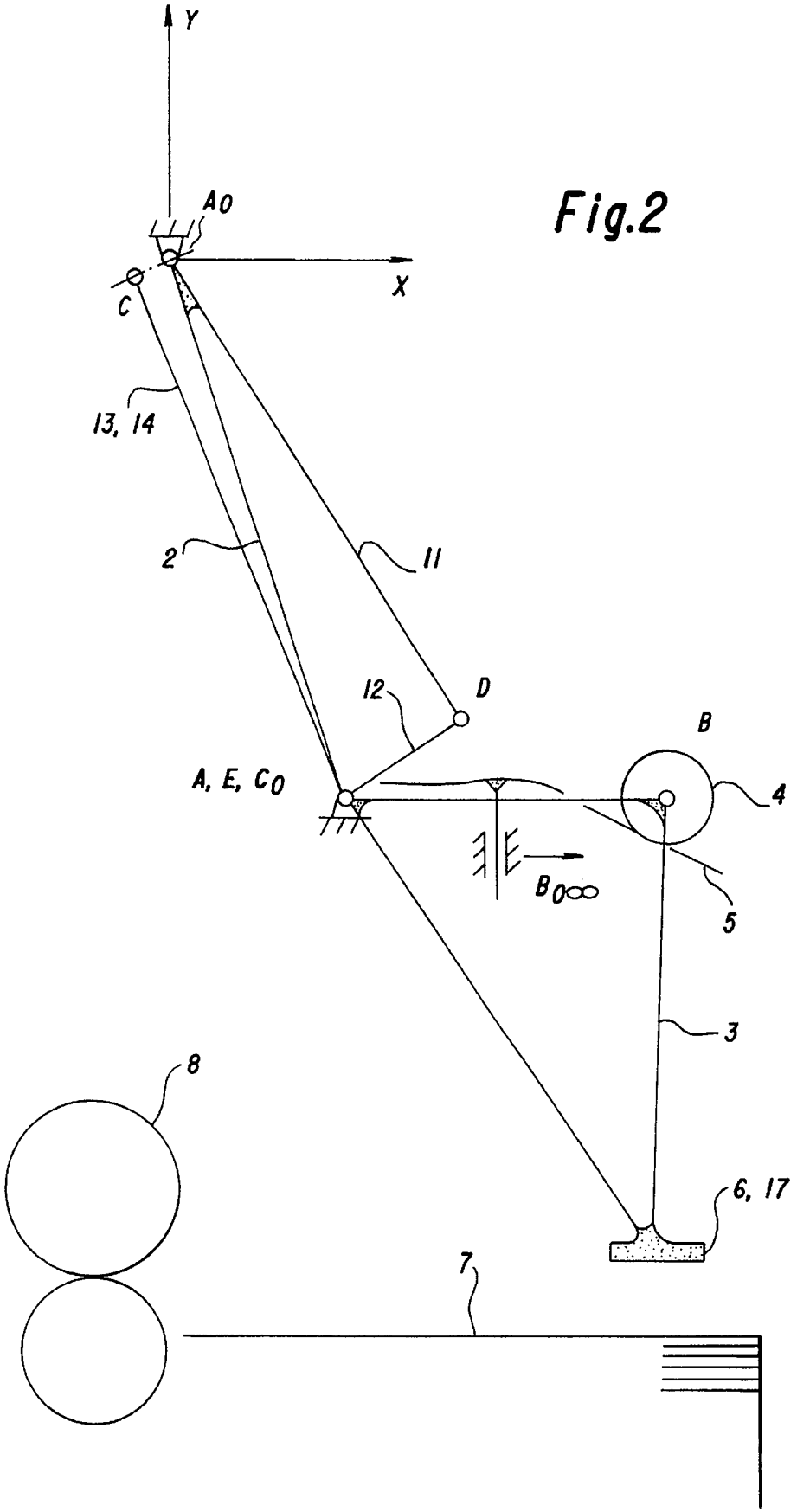
FIG. 2 is a predominantly diagrammatic and schematic side elevational view of FIG. 1 showing the sucker in a rearward position thereof.

Referring now to the drawings and, first, particularly to FIG. 1 thereof, there is shown therein a device for correcting skewed sheets in a feeder of a sheet-fed printing press wherein a sucker transmission has a rocker arm 2, supported on a frame 1 of the printing press, and driven so as to rock about an axis $A_o$, for example, by means of a cam disk, a preceding transmission gear, or other conventional drive elements, none of which are illustrated. A lower end of the rocker arm 2 is connected to an angularly shaped sucker carrier 3 so as to be pivotable about the axis A. A cam roller 4 is mounted on one arm of this sucker carrier 3, so as to be freely rotatable about an axis B, and so as to be supported on or braced against a cam segment 5. A first sucker 6 is articulatingly arranged on the lower end of the other arm of the sucker carrier 3. By purposefully superimposing motion of the articulating or pivot axes A and B, the sucker 6 is guided along a path so that the top sheet of the sheet pile is, respectively, engaged by its trailing edge, raised and, after supporting air is blown thereunder from below, transported horizontally to the feed table. In the starting position thereof, the lower surface of the sucker 6 is parallel to the surface of the sheet pile 7 (FIG. 2). In this position, the upper sheet of the pile 7 has suction applied thereto or is aspirated. Then, the sucker 6 is raised nearly vertically a defined distance, in the course of which the lower surface of the sucker 6 becomes inclined at a conventional desired angle to the horizontal. After air has been blown at the lifted sheet from below, the horizontal sheet transport takes place, the inclination of the sucker 6 being maintained. At the end of this horizontal movement, the sheet is transferred by its leading edge to suitable conventional transport means 8 of the feed table or the like, not shown in detail in the drawing. The sucker 6 is then returned to its starting position.

To adjust the height of the sucker 6, the cam segment 5 is disposed so as to be vertically movable relative to the printing-press frame 1. The height adjustment is effected by an adjusting spindle 9 with an adjusting wheel 10. By means of this height adjustment, the path of motion of the center of the sucker 6 is shifted. Simultaneously, a slight horizontal shift of the center of the sucker 6 occurs, due to which the sheet is engaged slightly farther to the rear or farther to the front, respectively, but is nevertheless transported the same horizontal distance to the non-illustrated feeder table.

For performing a skewed sheet correction, the sheet, which is disposed in the X-Z plane of the coordinate cross shown in FIG. 1, must be rotated about the Y axis. This is achieved by means of a three-dimensional embodiment of the sucker transmission, treated heretofore as though it were planar. In the exemplary embodiment shown in FIG. 1, the rocker arm 2 movable about the axis $A_o$ is firmly or permanently joined to a lever 11 which, via a coupling member 12, moves a further rocker arm 13 and is articulatingly connected with this further rocker arm so as to swivel about an axis F. The upper end of the rocker arm 13 is articulatingly connected with one end of an adjusting lever 14 so as to swivel about an axis C, the other end of the adjusting lever 14 being articulatingly connected to the printing-press frame 1 so as to swivel about an axis $C_o$. The adjusting lever 14 is adjusted in its position relative to the press frame 1 by means of an adjusting spindle 15 with an adjusting screw 16. The sucker carrier 3 is thus forcibly guided between the rocker arm 2 and the sucker carrier 3 in the joint A, in the joints with the axes F and E of the coupling member 12 with the second rocker arm 13 and with the sucker carrier 3, respectively, as well as by the pivot axis B of the cam roller 4. In the starting position of the sucker 6 and the sucker carrier 3, respectively, the articulating axes $C_o$ and A are identical; that is, adjusting the adjusting lever 14 shifts the articulating axis C, located between the rocker arm 13 and the adjusting lever 14, about the articulating axis $C_o$ on a circular path, which preferably has the radius $A_oA=CF=C_oC$.

In the illustrated exemplary embodiment of FIG. 1, a further sucker 17 is disposed on the sucker carrier 3 along with the sucker 6 mentioned hereinbefore. To enable the desired three-dimensional motion of the sucker carrier 3 and to prevent unnecessary freedoms of motion of the transmission members, the joints with the articulating or pivot axes A, C, D and F are embodied as ball and socket joints, and the joints with the articulating or pivot axes $A_o$, $C_o$ and E are embodied as hinges. The cam roller 4 has a spherical bearing surface, so that the transmission, due to these three-dimensional degrees of freedom, is not vulnerable to production and assembly errors.

The mode of operation of the skewed sheet correction is described hereinafter, starting from a zero position in which the sheets are set in mutually parallel relationship. In this basic condition, the adjusting lever 14 is in a position in which the axes of the joints $A_o$ and C are identical. The double crank formed of the elements 1, 11, 12 and 13 acts as a rigid coupling, so that the second rocker arm 13 executes a motion synchronous with the first rocker arm 2, without any angular offset. The axes of the joints A and E or F are identical over the entire operating play. The suckers 6 and 17 are moved parallel to one another, so that the sheet transport is parallel.

Figure 3:
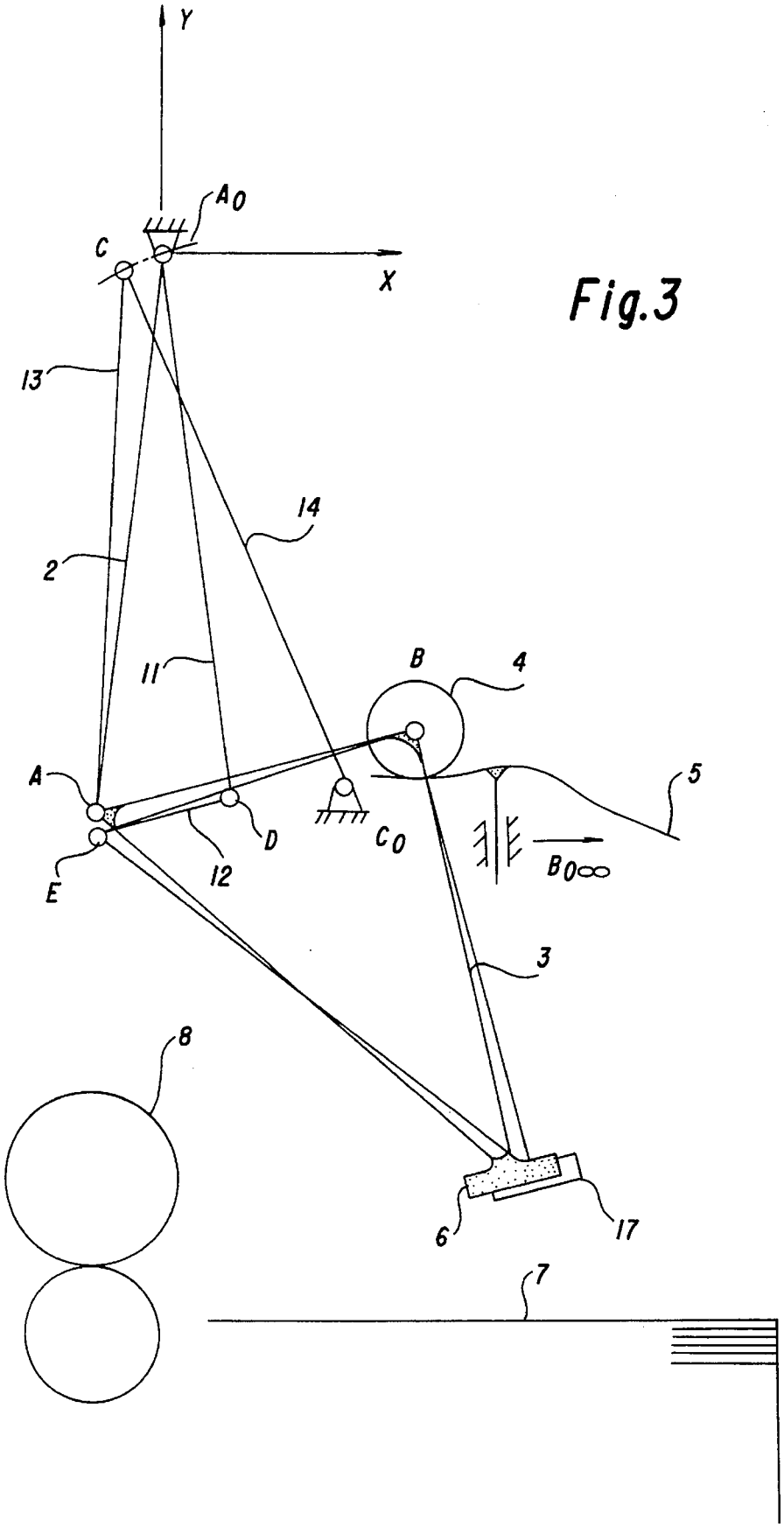
FIG. 3 is another predominantly diagrammatic and schematic side elevational view of FIG. 1 showing the sucker in a more forward position thereof relative to that of FIG. 2.

A pivoting or swivelling movement of the adjusting lever 14 about the axis $C_o$ by a rotation of the adjusting spindle 15 with the adjusting screw 16 in the mathematically positive direction of rotation about the Z axis, swivels or pivots the articulating axis C towards the left-hand side of the drawing, as shown in FIG. 2. The pivot axes E and F of the sucker carrier 3 maintain their original position, because the constant spacing of the axes $C_oC$, CE and CF does not change. Thus, the suckers 6 and 17, in the starting position, are also on a straight line which extends parallel to the Z axis. Due to the swinging movement of the rocker arm 2 out of the zero position (FIG. 3), the axes of the joints E and F, as a consequence of the transmission of motion by the elements 1, 11, 12 and 13 acting as a double crank, are deflected in such a manner that the center point of the sucker 17 lags in the horizontal X direction, when compared with the center point of the sucker 6. A rotation of the sucker carrier 3 about the Y axis takes place, thus effecting the desired skewed sheet correction along the transport path of the sheet. Because the two suckers 6 and 17 are located on a common sucker carrier 3, their spacing from one another remains constant. There is no extra mechanical strain on the sheet. During the movement out of the zero position, the sucker carrier 3 continues to experience a tilting movement about the Y axis, but it is so slight as to have no technological disadvantages. The lengths of the structural parts between the axes AD and DE are embodied dimensionally with such mass that minimal additional tilting occurs for the extreme inclined positions called for. Adjusting the adjusting spindle 15 by rotating the adjusting screw 16 in the mathematically negative direction causes the aforedescribed to be reversed. The arrangement can be used without limitation to guide more than two suckers, such as four suckers, for example. An identical mode of operation can be attained if, instead of the adjusting lever 14, a slide is disposed on the printing-press frame 1, the slide being then moved on a straight path by an adjusting screw or the like. The straight path represents a secant through the pivot axis C, which appears at the maximum positive and negative deflection, respectively, of the adjusting lever 14.

Figure 4:
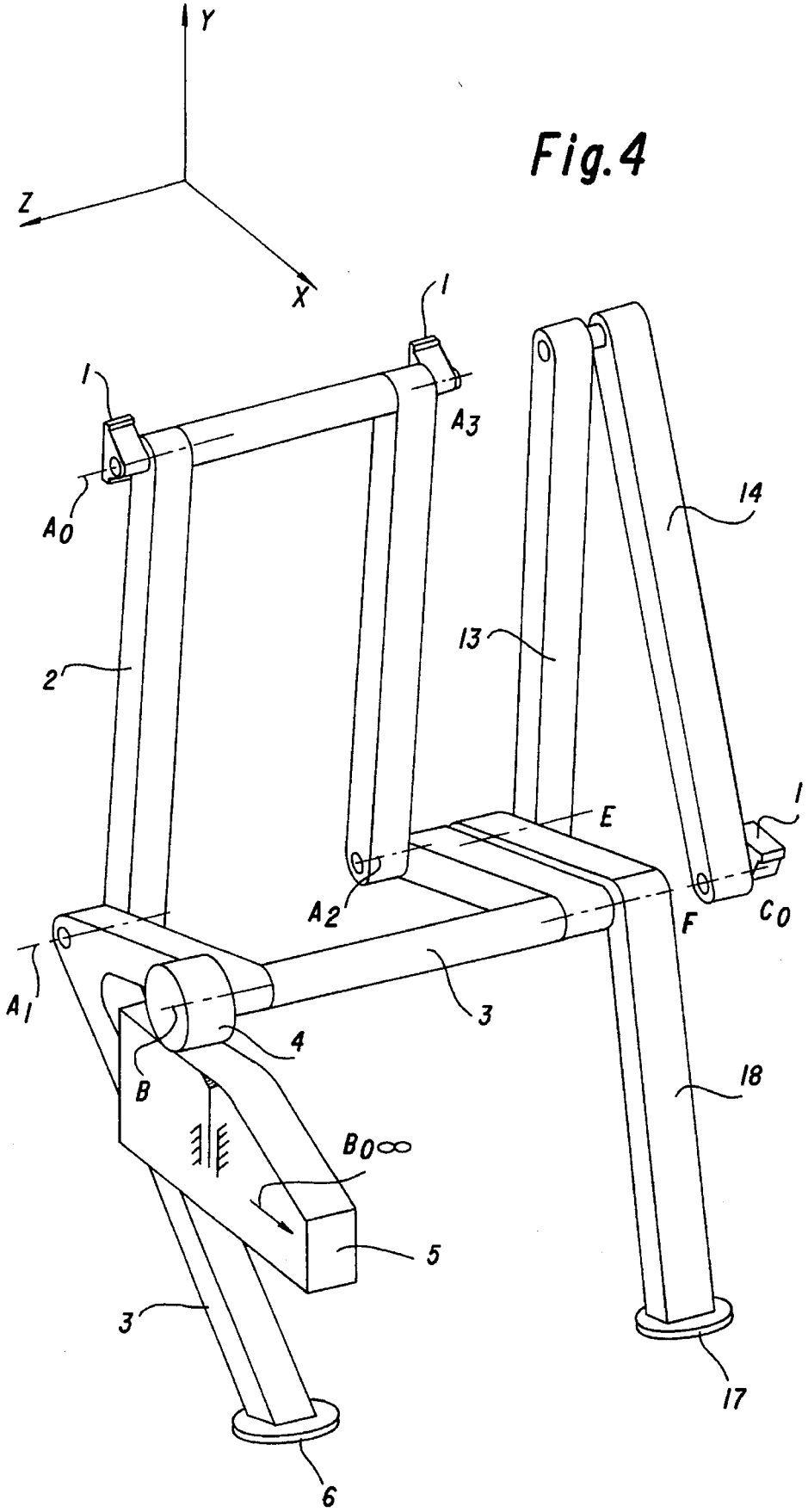
FIG. 4 is a perspective view, partly diagrammatic and schematic, and somewhat similar to that of FIG. 1 of another embodiment of the invention.

FIG. 4 shows a further exemplary embodiment of the device according to the invention which exhibits the characteristic structural features thereof. In this arrangement, there is only one sucker 6 directly on the sucker carrier 3. The sucker carrier 3 is supported on the rocker arm 2 by two parallel-disposed hinges with axes $A_1$ and $A_2$. The rocker arm 2 is supported in the press frame 1 by two parallel-disposed hinges $A_o$ and $A_3$. The forcible guidance of the sucker carrier 3 is achieved by means of the cam roller 4 which rolls on the cam segment 5. The second sucker 17 is located on one arm of a double-armed coupling member 18, which is supported on the sucker carrier 3 so as to be movable about an articulating or pivot axis F. Simultaneously, the coupling member 18 is supported by the other arm thereof on the rocker arm 13. The position of the adjusting lever 14 and hence of the joint having the pivot axis C, which connects the rocker arm 13 to the adjusting lever 14, is adjustable by an adjusting spindle 15 with an adjusting screw 16, as described hereinbefore with respect to FIG. 1. The mode of operation of the sucker height adjustment is equivalent to that of the embodiment of FIGS. 1 to 3. To achieve a largely independent adjustability for skewed sheet adjustment, the swivel axis F of the hinge of the coupling member 18 should preferably coincide, at the junction between the two arms thereof, with the pivot axis B of the hinge between the cam roller 4 and the sucker carrier 3. The skewed sheet correction is effected by deflection of the adjusting lever 16 (FIG. 1). In the zero position, the sucker 6 and the sucker 17 are located on a straight line parallel with the Z axis. A deflection of the rocker arm 2 out of the zero position causes an offset of the sucker 6 relative to the sucker 17, due to which the sheet being transported is rotated about the Y axis. In comparison with the exemplary embodiment of the device described earlier herein, relative motion takes place between the two suckers 6 and 17. The change in spacing is minimal, however, and can readily be compensated for by the rubber suction cups of the suckers. It is advantageous, however, to use economical hinges or swivel joints.

We claim:

1. Device for skewed sheet correction in a feeder of a sheet-fed printing press, comprising a driven movable sucker carrier, at least one height-adjustable sucker disposed on said driven movable sucker carrier for horizontally transporting and simultaneously aligning a sheet lifted from a sheet pile, a rocker arm mounted in a frame of the printing press, said sucker carrier being articulatingly connected to and driven by said rocker arm so as to be movable in a feeding direction of the sheet and swingably driven, and a cam guide which is adjustable in height, said sucker carrier being in contact with said cam guide, and another rocker arm articulating connect to said sucker carrier so as to be driven therewith, and an adjustable support for said another rocker arm.

2. Device according to claim 1, including a bearing for the first-mentioned rocker arm mounted to the press frame, said another rocker arm having a support bearing disposed coaxially with the bearing for the first-mentioned rocker arm, in a zero position of the sucker, and being adjustable out of said zero position.

3. Device according to claim 1, wherein said adjustable support includes, an adjusting lever having an articulating axis on the press frame disposed coaxially with an articulating axis of the first-mentioned rocker arm, in a zero position of the sucker, said another rocker arm being supported on said adjusting lever, and an adjusting device connecting said adjusting lever adjustably about an articulating axis to the press frame.

4. Device according to claim 3, including a sucker-bearing coupling member to which said another rocker arm is connected so as to articulate about a swivel axis extending transversely to the sheet feeding direction, said coupling member being supported so as to articulate about an articulating axis of the sucker carrier, the articulating axis and the swivel axis of said coupling member being aligned coaxially with one another in a zero position of the suckers.

5. Device according to claim 1, including a rocker-arm lever rigidly connected to said another rocker arm and a coupling member connected to said another rocker arm and said rocking-arm lever, said another rocker arm being articulatingly connected through the intermediary of said coupling member to said rocking-arm lever.

6. Device according to claim 1, wherein a plurality of suckers are disposed on the sucker carrier.

7. Device according to claim 1, including a coupling member to which said another rocker arm is connected so as to articulate about an axis extending transversely to the sheet feeding direction, said coupling member being supported so as to articulate about a swivel axis on the sucker carrier.

* * * * *